US008257893B2

(12) United States Patent
Lin et al.

(10) Patent No.: US 8,257,893 B2
(45) Date of Patent: Sep. 4, 2012

(54) POLYESTER-BASED PHOTORECEPTOR OVERCOAT LAYER

(75) Inventors: Liang-Bih Lin, Rochester, NY (US); Brian P. Gilmartin, Williamsville, NY (US); Emily K. Redman, Webster, NY (US); Marc J. LiVecchi, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 415 days.

(21) Appl. No.: 12/568,548

(22) Filed: Sep. 28, 2009

(65) Prior Publication Data

US 2011/0076604 A1 Mar. 31, 2011

(51) Int. Cl.
*G03G 5/00* (2006.01)

(52) U.S. Cl. ..... 430/66; 430/58.35; 430/59.6

(58) Field of Classification Search ..... 430/58.35, 430/59.6, 66

See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,387,980 | A | 6/1983 | Ueno et al. | |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,300,391 | A * | 4/1994 | Fabian et al. | 430/127 |
| 5,756,245 | A | 5/1998 | Esteghamatian et al. | |
| 2006/0105264 | A1 * | 5/2006 | Dinh et al. | 430/132 |

* cited by examiner

*Primary Examiner* — Thorl Chea
(74) *Attorney, Agent, or Firm* — Pillsbury Winthrop Shaw Pittman LLP

(57) ABSTRACT

The presently disclosed embodiments are directed generally to an improved electrostatographic imaging member in which the overcoat layer comprises cross-linkable polyester resins. The overcoat layer not only provides wear resistance, but it also provides higher charge transport efficiency and therefore better photoelectrical properties. In addition, the polyesters can cross-link with a variety of resins and thus provide good adhesion as well.

18 Claims, 2 Drawing Sheets

POLYESTER-BASED PHOTORECEPTOR OVERCOAT LAYER

BACKGROUND

The presently disclosed embodiments relate generally to a novel overcoat layer formulation based on cross-linkable polyester resins that is used to form a cross-linked protective outer coating or layer on a photoreceptor. The overcoat layer not only provides wear resistance, but it also provides higher charge transport efficiency and therefore better photoelectrical properties. In addition, the polyesters can cross-link with a variety of resins and thus provide good adhesion as well.

In electrophotographic or electrostatographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrostatographic copying process is well known and is commonly used for light lens copying of an original document. Analogous processes also exist in other electrostatographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The outer surface of the image bearing member is charged with the rubbing friction at the contact area. The contact type charging device charges the image bearing member to a predetermined potential. Typically the contact type charger is in the form of a roll charger such as that disclosed in U.S. Pat. No. 4,387,980, the relative portions thereof incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Extending the lifetime of xerographic imaging members creates challenges in meeting the critical quality requirements, in particular for bias charge roll-based engines, where the contact charging is notorious for causing abrasion and related or unrelated print defects. To improve robustness against mechanical wear, there are two commonly-used methods—one is to enhance wear resistance of charge transport layer and the other is to apply a protective overcoat. Each method has its own advantages and disadvantages, however, it is predicted that life extension in the future will be based on some form of overcoat layer. One serious concern with using overcoat layers is the compromise on electrical performance, namely, the photoinduced discharge characteristics (PIDC) curve becomes "softer", i.e. increases of surface potential, with the presence of an overcoat layer, making many overcoat layers not suitable for xerographic applications.

Therefore, a need remains for a photoreceptor overcoat layer that can provide wear resistance without adversely impacting electrical performance of the photoreceptor.

SUMMARY

According to aspects illustrated herein, there is provided an imaging member further comprising a substrate, a charge generation layer, a charge transport layer, and an overcoat layer disposed on the charge transport layer, wherein the overcoat layer further comprises a cross-linkable and unsaturated polyester resin, a hydroxyl-containing charge transport molecule, and a melamine-based curing agent, the polyester resin comprising unsaturated chains comprised of carboxylic acid or ester moieties, or mixtures thereof.

Another embodiment provides an imaging member further comprising a substrate, a charge generation layer, a charge transport layer, and an overcoat layer disposed on the charge transport layer, wherein the overcoat layer further comprises a cross-linkable and unsaturated polyester resin, a hydroxyl-containing charge transport molecule, and a melamine-based curing agent, the polyester resin comprising unsaturated chains comprised of carboxylic acid or ester moieties, or mixtures thereof and further wherein the imaging member exhibits a lower wear rate than that of an overcoat layer without the polyester resin as tested on a standard biased charging roll wear fixture and exhibits similar surface potential and residual voltage as an overcoat layer without the polyester resin.

Yet another embodiment, there is provided an electrophotographic system comprising an imaging member further comprising a substrate, a charge generation layer, a charge transport layer, and an overcoat layer disposed on the charge transport layer, wherein the overcoat layer further comprises a cross-linkable and unsaturated polyester resin, a hydroxyl-containing charge transport molecule, and a melamine-based curing agent, the polyester resin comprising unsaturated chains comprised of carboxylic acid or ester moieties, or mixtures thereof; and a bias charging member in contact with the imaging member for uniformly charging a surface of the imaging member.

BRIEF DESCRIPTION OF THE DRAWINGS

For a better understanding, reference may be made to the accompanying figures.

DETAILED DESCRIPTION

Figure 1:
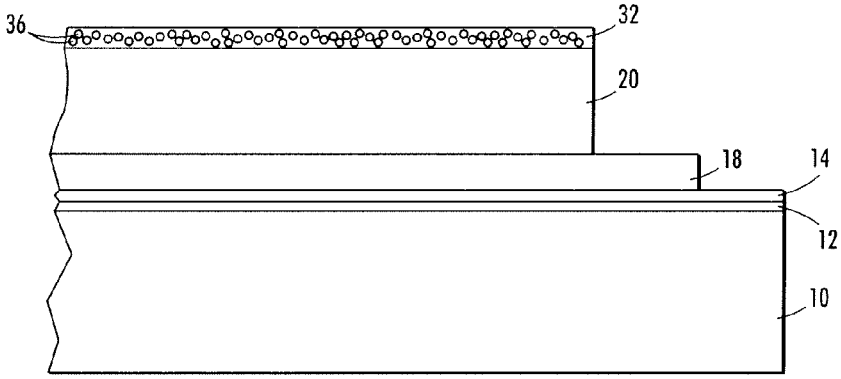
FIG. 1 is a cross-sectional view of an imaging member in a drum configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to a protective outer coating or layer comprising cross-linkable polyester resin. The overcoat layer not only provides wear resistance, but better photoelectrical properties. Due to the non-polar nature of polyester resins, the overcoat layer has higher charge transport efficiency and therefore better photoelectrical properties. In addition, the polyesters can cross-link with a variety of resins and thus provide good adhesion as well.

In typical imaging member overcoat layers, the wear resistance is provided by the enhancement of mechanical strength of cross-linked (e.g., cured) films. However, due to the underlying molecular moieties and chemical linkages, this advantage comes at the cost of photoelectrical properties degradation, notably softer photoinduced discharge characteristic curves and higher surface potential and residual voltage. The increase in voltage is strongly dependent, mostly non-linearly, on overcoat thickness. For applications requiring very long life, especially for contact charging system like bias charge roller (BCR) where notoriously high wear is well-known, thick overcoat layers would be needed. Use of the needed thickness would increase the difficulty in fulfilling the specifications for photoelectrical properties.

The present embodiments address the long-standing problems described above by incorporating cross-linkable and unsaturated polyester binder in melamine-containing overcoat layers to produce photoreceptors with long life and which exhibit good photoelectrical properties. Unlike polyether binders used in conventional melamine-containing overcoat layers, polyesters are non-polar and therefore are expected to facilitate better charge transport across the layer which would allow using thicker overcoat layers without compromising electrical performance (e.g., residual potential (Vr)).

In electrostatographic reproducing or digital printing apparatuses using a photoreceptor, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member having a drum configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

For life extension of xerographic imaging members, there are many challenges in meeting all of the critical quality requirements, especially for bias charge roll based engines where the contact charging is notorious for causing abrasion and related or unrelated print defects. To improve imaging member life, two main approaches are generally used—incorporation of an organic protective overcoat in the imaging member or enhancing wear resistant of charge transport layer. Both methods have shown some merit but generally the life improvements are insufficient for future products due to limitation of their inherent material properties. The present embodiments provide an overcoat based on the incorporation of cross-linkable and unsaturated polyester resins, into a melamine-containing overcoat layer for life extension of the imaging member. Overcoat layers having such compositions have shown improved wear resistance without negative impact to the photoelectric properties.

In the present embodiments, the overcoat layer comprises a suitable hole transport material, such as for example, dihydroxymethyl-triphenyl-amine, N,N'-diphenyl-N,N'-bis(3-hydroxyphenyl)-[1,1'-biphenyl]-4,4'-diamine, and the like, a hydroxyl-containing charge transport molecule, a polymer binder, and a melamine-based curing agent, which, upon thermal curing, will form a cross-linked overcoat layer. A variety of polymers can be used for the protective overcoating layer binder, however, it has been difficult to find polymers that satisfy the coatability, mechanical robustness as well as the electrical requirements of a photoreceptor. The present embodiments employ cross-linkable polyester resins which, because such polymers are non-polar, facilitate better charge transport across the overcoat layer and thus allow for thicker overcoat layers without compromising electrical performance.

In embodiments, there is provided an imaging member further comprising a substrate, a charge generation layer, a charge transport layer, and an overcoat layer disposed on the charge transport layer, wherein the overcoat layer further comprises a cross-linkable and unsaturated polyester resin, a hydroxyl-containing charge transport molecule, and a melamine-based curing agent, the polyester resin comprise unsaturated chains comprised of carboxylic acid and ester moieties, and the like. In particular embodiments, the cross-linkable resin is a high solids resin comprising polyester resin, toluene and propylene glycol monomethyl ether acetate. In a particular embodiment, the cross-linkable resin comprises from about 79 percent to about 81 percent of the polyester resin by weight of the total weight of the cross-linkable resin, from about 6 percent to about 8 percent of the toluene by weight of the total weight of the cross-linkable resin, and from about 12 percent to about 14 percent of the propylene glycol monomethyl ether acetate by weight of the total weight of the cross-linkable resin. It is surmised that, because of the non-polar nature of such polymers due to the presence of ethylenically unsaturated moiety, the polyester resins provide good cross-linking without deteriorating too much of the charge transport efficiency. These resins are also known to have good chemical resistance, excellent adhesion to various surfaces, and good hardness and flexibility.

The polyester resin may be present in the overcoat layer in an amount of from about 2 percent to about 70 percent. In other embodiments, the polyester resin is present in the overcoat layer in an amount of from about 5 percent to about 40 percent. In yet other embodiments, the polyester resin is present in the overcoat layer in an amount of from about 10 percent to about 25 percent solids in the overcoat layer.

In specific embodiments, the charge transport molecule is N,N'-diphenyl-N,N'-bis(3-hydroxyphenyl)-[1,1'-biphenyl]-4-4'-diamine (DHTBD) and the melamine-based curing agent is hexamethoxymethylmelamine. In embodiments, the overcoat layer may also comprise a catalyst and a low surface energy additive such as a fluorinated molecule, a fluorinated polymeric material, a siloxane containing material, and the like.

The overcoat layer may be formed by thermal curing at a temperature of about from about 60° C. to about 200° C., and for about 5 minutes to about 60 minutes. In embodiments, the cured overcoat layer has an average film thickness of from about 1 μm to about 18 μm, or from about 3 μm to about 6 μm.

Figure 2:
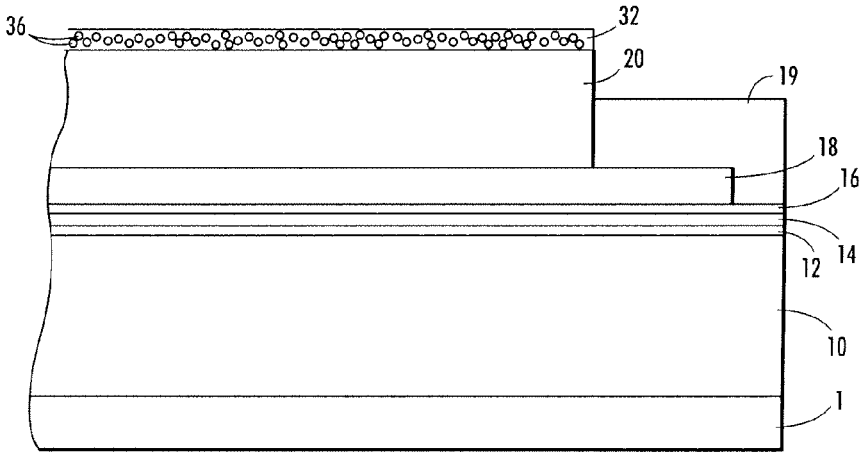
FIG. 2 is a cross-sectional view of an imaging member in a belt configuration according to the present embodiments.

FIG. 2 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference. In embodiments, the overcoat layer 32 comprises specific cross-linkable polyester resins 36 to provide increased wear resistance and life extension of the imaging member, and can be surface treated or untreated. In embodiments, the cross-linkable polyester resins 36 is dispersed into the overcoat layer. The cross-linkable polyester resins 36 may be present in a layer having a thickness of from about 0.2 μm to about 10 μm, or from about 0.2 μm to about 1 μm.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethyiamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

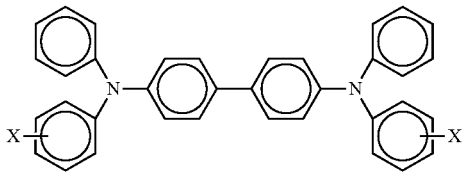

and

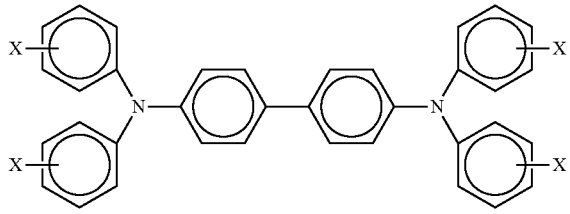

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

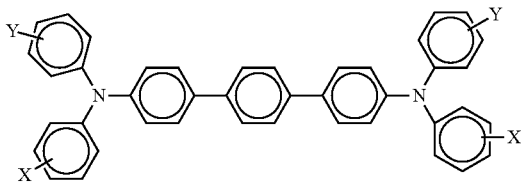

and

-continued

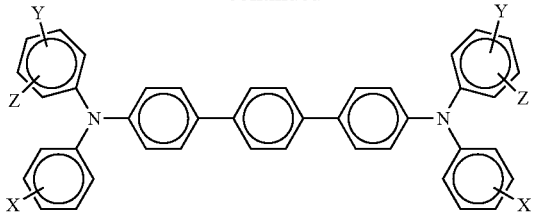

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARKT™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Control Example 1

A conventional overcoat formulation was made from a solution comprising a hydroxyl-containing charge transport molecule, a polyol polymer binder, and a melamine-based curing agent. The solution was applied onto the photoreceptor surface and more specifically onto the charge transport layer via dip coating. Finally thermal curing was done to form a cross-linked overcoat layer having an average film thickness of about 3-6 μm.

Example 1

Preparation of the Inventive Overcoat Layer

The overcoat solution of Control Example 1 is used except that an unsaturated polyester is used as the polymer binder and mixed into the overcoat solution. Specifically, the polyester resin used was AROPLAZ A6-80, available from Reichhold, Inc. (Durham, N.C.). The polyester is formulated with N,N'-diphenyl-N,N'-bis(3-hydroxyphenyl)-[1,1'-biphenyl]-4-4'-diamine (DHTBD), a melamine resin (CYMEL 303), available from Cytec, Ind. (Woodland Park, N.J.), and optionally, a catalyst and low surface energy additive. The overcoat solution was applied by dip coating.

Figure 3:
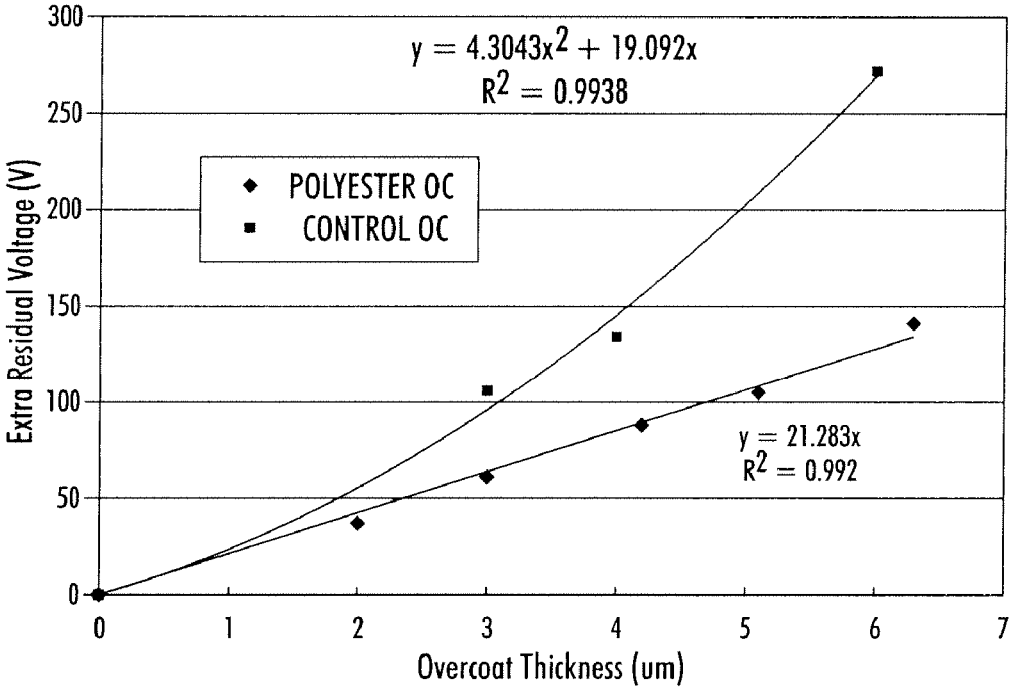
FIG. 3 is a graph illustrating the photoinduced discharge characteristics of imaging members made according to the present embodiments.

For applications requiring very long life, especially for contact charging system like bias charge roller (BCR) where notoriously high wear is well-known, thick overcoat layers are needed. Use of the required thickness would increase the difficulty in fulfilling the specifications for photoelectrical properties. A classic example of steep increase in residual voltage is shown in FIG. 3. The dependency of extra residual voltage versus overcoat thickness of the control overcoat layer is found to be $4.3x+19.1x^2$, where x is the thickness (in μm) of the overcoat. This means that, at 3 μm (6 μm) overcoat thickness, residual voltage will increase by about 100 V (260 V), as shown in FIG. 3. Since wear rate of overcoat in BCR systems is typically 6-10 nm/kc, 5-6 μm overcoats are usually required to achieve an operating life of 500 k prints or more. However, based on the formula above, an overcoat comprising the conventional formulation cannot be functional at such a high thickness.

A series of experiments were executed to find the optimal combinations for photoelectrical properties and wear performance. The relationship of increase in residual voltage versus the inventive polyester overcoat thickness is shown in FIG. 3, where the data can be fitted linearly at a slope of 21.3 V per μm. At about 6 μm overcoat thickness, the difference in residual voltage is over 100 V for the polyester overcoat and the control example overcoat, a very significant improvement and making the photoreceptor design more suitable for long life applications.

Figure 4:
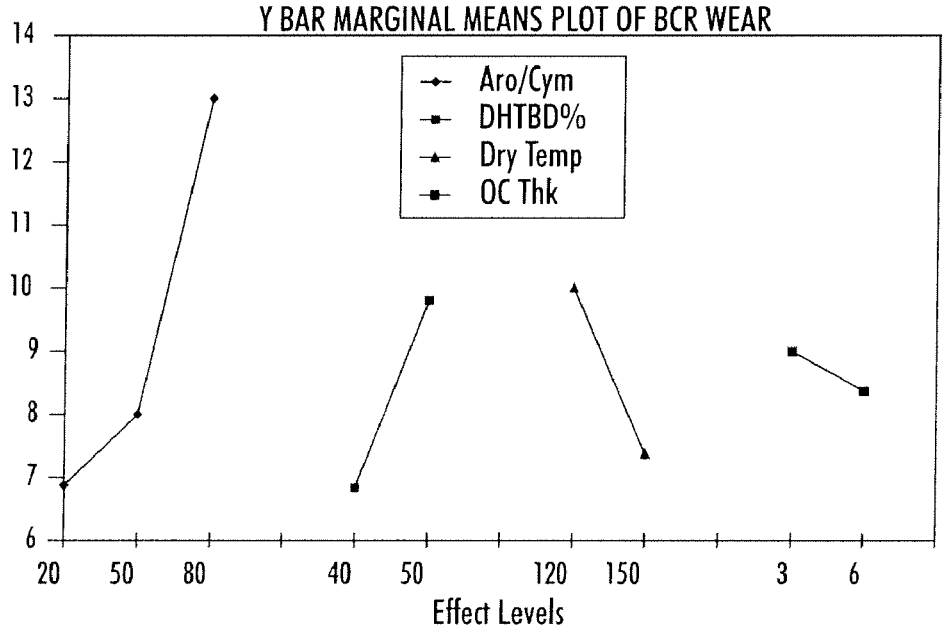
FIG. 4 is a graph illustrating wear resistance of overcoat layers in imaging members made according to the present embodiments.

Wear rate performance of the inventive polyester overcoat was measured on a standard BCR (biased charging roll) wear fixture and the average wear rates were found to be about 6-10 nm. FIG. 4 shows the marginal means plot of BCR wears vs. various factors, obtained through the series of experiments. FIG. 4 illustrates the relationships between BCR wear rates (in nm/kc) versus various factors—"Aro/Cym" is the weight ratio between the AROPLAZ A6-80 polyester and CYMEL 303 resin, "DHTBD %" is the loading weight percentage of DHTBD, "Dry Temp" is the drying temperature in Celsius, and "OC thk" is the overcoat thickness (in μm). A wear rate of 8 nm or below can be easily controlled via, for example holding the weight ratio of the polyester resin versus CYMEL resin below 50%, or drying temperature at 150° C. The weight ratio between the crosslinking components will change crosslinking behaviors and/or properties such as crosslinking density, and thus, will affect wear rate. Similarly, usually the higher the drying (curing) temperature, the more the crosslinking occurs, and thus, the better the wear rate. In embodiments, a weight ratio of the polyester resin to the melamine-based curing agent in the overcoat layer is from about 5/90 to about 90/5, or from about 20/80 to about 80/20. It is demonstrated that the polyester overcoat has a large operating window in wear rate with respect to various factors, especially loading of DHTBD, where higher loading would produce better photoelectrical properties. The overcoats were also subjected to A zone deletion (lateral charge migration) test and found a grade of about G3, typical performance for overcoats.

Long term cycling properties of the overcoats were also investigated using HMT test in both A and J zones as compared to standard PTFE CTL-only devices. All overcoat devices tested exhibited very stable $V_{high}$ and less than 100 volts cycle-up in $V_{low}$ after 400 k cycles in both zones.

In summary, it has been demonstrated that an overcoat layer based on unsaturated polyester resins provides good wear resistance and print quality, and further exhibits excellent photoelectrical properties, including time zero residual potential and long term cycling performances. Moreover, the observed significant reduction in excessive Vr should allow up to a two-fold increase in overcoat thickness (as compared to the conventional overcoat formulation) without compromising electrical properties.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member further comprising
a substrate,
a charge generation layer,
a charge transport layer, and
an overcoat layer disposed on the charge transport layer, wherein the overcoat layer further comprises a cross-linkable and unsaturated polyester resin, a hydroxyl-containing charge transport molecule, and a melamine-based curing agent, the cross-linkable and unsaturated polyester resin being a high solids resin comprising polyester resin, toluene and propylene glycol monomethyl ether acetate and further comprising unsaturated carbon chains comprised of carboxylic acid or ester moieties, or mixtures thereof.

2. The imaging member of claim 1, wherein the polyester resin is present in the overcoat layer in an amount of from about 2 percent to about 70 percent.

3. The imaging member of claim 2, wherein the polyester resin is present in the overcoat layer in an amount of from about 5 percent to about 40 percent.

4. The imaging member of claim 1, wherein the polyester resin is present in the overcoat layer in an amount of from about 10 percent to about 25 percent solids in the overcoat layer.

5. The imaging member of claim 1, wherein a weight ratio of the polyester resin to the melamine-based curing agent is from about 5/95 to about 95/5.

6. The imaging member of claim 1, wherein the overcoat layer further comprises a catalyst and a low surface energy additive selected from the group consisting of a fluorinated molecule, a fluorinated polymeric material, a siloxane-containing material, and mixtures thereof.

7. The imaging member of claim 1, wherein the charge transport molecule is N,N'-diphenyl-N,N'-bis(3-hydroxyphenyl)-[1,1'-biphenyl]-4-4'-diamine (DHTBD) and the melamine-based curing agent is hexamethoxymethylmelamine.

8. The imaging member of claim 1, wherein the overcoat layer is formed by thermal curing at a temperature of about from about 80° C. to about 200° C., and for about 5 minutes to about 60 minutes.

9. The imaging member of claim 8, wherein the cured overcoat layer has an average film thickness of from about 1 μm to about 20 μm.

10. An imaging member further comprising
a substrate,
a charge generation layer,
a charge transport layer, and
an overcoat layer disposed on the charge transport layer, wherein the overcoat layer further comprises a cross-linkable and unsaturated polyester resin, a hydroxyl-containing charge transport molecule, and a melamine-based curing agent, the cross-linkable and unsaturated polyester resin being a high solids resin comprising polyester resin, toluene and propylene glycol monomethyl ether acetate and further comprising unsaturated carbon chains comprised of carboxylic acid or ester moieties, or mixtures thereof and further wherein the imaging member exhibits a lower wear rate than that of an overcoat layer without the polyester resin as tested on a standard biased charging roll wear fixture and exhibits similar surface potential and residual voltage as an overcoat layer without the polyester resin.

11. The imaging member of claim 10, wherein the overcoat layer is formed through thermal curing and has an average film thickness of from about 1 μm to about 20 μm.

12. An electrophotographic system comprising:
an imaging member further comprising
a substrate,
a charge generation layer,
a charge transport layer, and
an overcoat layer disposed on the charge transport layer, wherein the overcoat layer further comprises a cross-linkable and unsaturated polyester resin, a hydroxyl-containing charge transport molecule, and a melamine-based curing agent, the cross-linkable and unsaturated polyester resin being a high solids resin comprising polyester resin, toluene and propylene glycol monomethyl ether acetate and further comprising unsaturated carbon chains comprised of carboxylic acid or ester moieties, or mixtures thereof; and
a bias charging member in contact with the imaging member for uniformly charging a surface of the imaging member.

13. The electrophotographic system of claim 12, wherein the substrate is configured to be in a belt form or a drum form.

14. The electrophotographic system of claim 12, wherein the polyester resin is present in the overcoat layer in an amount of from about 10 percent to about 30 percent.

15. The electrophotographic system of claim 12, wherein a weight ratio of the polyester resin to the melamine-based curing agent is from about 20/80 to about 80/20.

16. The electrophotographic system of claim 12, wherein the overcoat layer further comprises a catalyst and a low surface energy additive.

17. The electrophotographic system of claim 12, wherein the charge transport molecule is N,N'-diphenyl-N,N'-bis(3-hydroxyphenyl)-[1,1'-biphenyl]-4-4'-diamine and the melamine-based curing agent is hexamethoxymethylmelamine.

18. The electrophotographic system of claim 12, wherein the overcoat layer is formed by thermal curing at a temperature of about from about 80° C. to about 200° C., and for about 5 minutes to about 60 minutes, and wherein the cured overcoat layer has an average film thickness of from about 1 μm to about 20 μm.

* * * * *